United States Patent [19]

Evensen

[11] Patent Number: 4,481,637

[45] Date of Patent: Nov. 6, 1984

[54] ARRANGEMENT OF ELECTRODE HOLDERS

[75] Inventor: Knut Evensen, Oslo, Norway

[73] Assignee: Elkem a/s, Oslo, Norway

[21] Appl. No.: 464,117

[22] Filed: Feb. 4, 1983

[30] Foreign Application Priority Data

Feb. 12, 1982 [NO] Norway ..... 820417

[51] Int. Cl.[3] ..... H05B 7/107

[52] U.S. Cl. ..... 373/97

[58] Field of Search ..... 373/89, 97, 100

[56] References Cited

U.S. PATENT DOCUMENTS 1,928,854 10/1933 Grolee ..... 373/97

4,154,974 5/1979 Wynne ..... 373/100

*Primary Examiner*—Roy N. Envall, Jr.

*Attorney, Agent, or Firm*—Lucas & Just

[57] ABSTRACT

The present invention relates to an assembly and a method for feeding electrodes which are used in electrothermic smelting furnaces. The electrode comprises an electrode casing having vertical ribs projecting radially outwards from the casing. A plurality of electrode feeding units, each including a clamping means are arranged around the periphery of the electrode and each clamping means exerts a releasable pressure on a rib, the clamping means imposing only tangentially forces on to the electrode. When feeding the electrode, the pressure on one of the clamping means is temporary released and the clamping means is moved in vertical direction relative to the electrode, whereafter the pressure on the clamping means is reactivated. This is done for every electrode feeding unit with a preset time-delay between the movements. When all the electrode feeding units have been moved one at a time, all the electrode feeding units are moved together in vertical direction. The clamping means are formed of two substantially identical reversed parts which are hinged around a central member.

12 Claims, 3 Drawing Figures

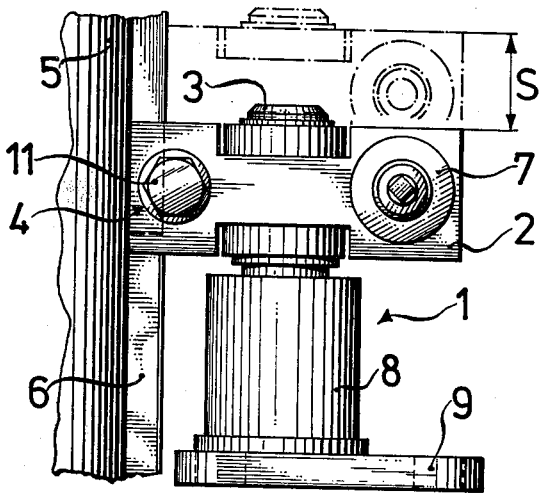
FIG. 2
FIG. 3
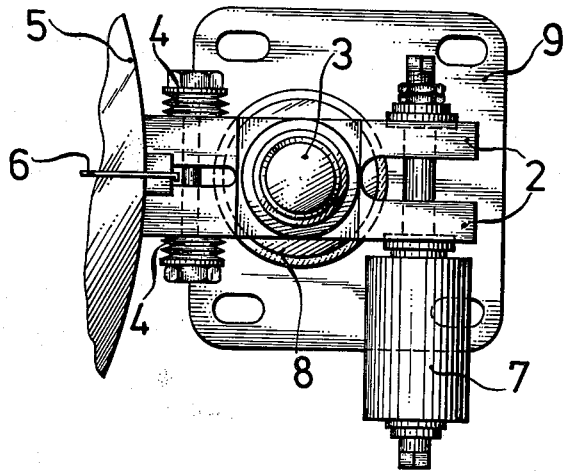

ARRANGEMENT OF ELECTRODE HOLDERS

The present invention relates to an assembly and a method for feeding of electrodes which are used in electro-thermic smelting furnaces. In particular the assembly and the method for feeding of electrodes according to the present invention are intended to be used in conjunction with self-baking electrodes such as conventional "Soederberg" electrodes.

For feeding of such electrodes there is a need for feeding means where the possibility for uncontrolled feeding of the electrode is eliminated. The electrode feeding means must further be so simple to produce as possible and it must be easy to perform maintenance work on the electrode feeding means without downtime of the furnace. Further the feeding increment must be easy to adjust and the time interval between each feeding cycle must be easy to regulate.

In the known systems for feeding electrode there is usually arranged two holder rings around the electrode, which rings exert radial forces to the electrode. When feeding the electrode the pressure must be released on at least one of the holder rings. Consequently at least 50% of the holding force is lost. When feeding the electrode by this conventional feeding means, the pressure of the first of the holder rings is released and the first ring is moved vertically relative to the second holder ring and the electrode, whereafter the pressure on the first holder ring is reactivated. The pressure on the second holder ring is then released and the electrode is fed down by lowering the first holder ring. When the feeding movement is finished the pressure on the second holder ring is reactivated.

It has been discovered that an electrode feeding assembly of this kind imposes relatively large radial forces on the electrode casing and on the electrode itself. With this large radial forces there is a danger for detrimental deformation of the electrode casing and hence of the electrode itself. With the deformation of the electrode casing there is also a danger for totally loosing the holding force imposed on the electrode casing by the holder rings.

In the known systems for feeding electrodes, the feeding increments vary too much for every feeding cycle. The feeding increments can therefore not be used as a safe parameter for the electrode consumption. Further with the known systems for feeding electrode the furnace have to be shut down for every kind of maintenance work on the electrode feeding means.

In accordance with the present invention the disadvantages and drawbacks of the previously known electrode feeding means has been overcome by means of an electrode feeding assembly comprising a plurality of electrode feeding units which are symmetrically arranged around the periphery of the electrode, which electrode feeding units comprise clamping means that impose a releasable pressure on continuous vertical ribs that extend radially outwards from the electrode casing in such a way that substantially only tangential forces are imposed to the electrode. According to a preferred embodiment of the present invention, each clamping means is formed of two substantially identical, reversed parts which are disposed on each side of the outwardly projecting ribs on the electrode casing. The two halves of the clamping means are hinged on a central member and are pressed together by means of a suitable pressure device. Further the electrode feeding units according to the present invention have means to temporary releasing of the pressure on the clamping means. The means for temporary releasing the pressure on the clamping means is preferentially arranged on that end of the clamping means which is remote from the ribs and the pressure device.

The pressure on the clamping means can for example be imposed by one or more springs which are tangentially arranged relatively to the electrode. The springs are preferentially furnished with a bolt and nut, which permits regulation of the clamping force. The central member on which the two halves of the clamping means are hinged, is preferentially the piston of a pneumatic or hydraulic cylinder.

In accordance with the present invention there is provided an electrode feeding assembly which assure safe and controlled feeding of the electrode relative to the electrode holder and at the same time completely or partially, contribute to the holding force for the electrode.

The cycle for feeding the electrode according to the present invention, is as follows: The pneumatic or hydraulic cylinder for each feeding unit is adjusted to the exact same feeding length. This length is called the feeding increment. The means for temporary releasing the clamping pressure for one of the feeding units is activated. The clamping means is thereby free to be moved relative to the electrode. This is done by activating the pneumatic or hydraulic cylinder. When the clamping means has been moved to its upper position, the means for temporary releasing the clamping pressure is reactivated and the clamping means is again imposing pressure on the ribs. This cycle is done for every electrode feeding unit around the periphery of the electrode with a preset time-delay for the activation of every unit. This means that only the feeding unit which is being moved at a given time does not contribute to the holding force of the electrode. When all electrode feeding units have been moved to their upper position and they all impose holding force to the ribs, the pneumatic or hydraulic cylinders for all th electrode feeding units are deactivated at the same time and the electrode is fed down the preset feeding increment.

The feeding increment can be easily and exactly adjusted. The normal feeding increment will be about 3 to 30 mm. The time between each feeding cycle can also be regulated. The time interval between each feeding cycle can for example be regulated from about 10 minutes to about 4 hours. With this possibility for regulation, the feeding can be adjusted to the actual electrode consumption. The electrode feeding assembly and the method for feeding electrode according to the present invention, will give the exact same feeding increment for each feeding cycle and by counting the feeding cycles it is possible to record the electrode consumption at every moment.

According to the present invention there is arranged a plurality of electrode feeding units around the periphery of the electrode. If for example six electrode feeding units are arranged, ony 17% of the holding force is lost when the pressure on the clamping means for one of the electrode feeding units is released. When the conventional electrode feeding units with two holder rings are used, at least 50% of the holding force will be lost when feeding the electrode. Further, according to the present invention the force on the ribs can be very high without the risk of deformation of the electrode casing because the clamping units impose substantially only tangential force on the electrode casing.

For maintenance work on the electrode feeding units at least one unit can be removed without need for furnace downtime and without any risk for uncontrolled feeding of the electrode as only 17% of the holding force of the electrode feeding assembly is lost when one of the electrode feeding units is removed.

Furthermore the electrode feeding assembly according to the present invention can be used for electrodes with highly different diameters. The feeding units are small and occupies a small volume. The height of the feeding units according to the present invention is about 400 mm, whereas the conventional feeding systems have a height of up to 4000 mm.

Further features and advantages of the present invention will be seen from the description of the drawings wherein;

FIG. 2 shows a vertical front elevation of one of the electrode feeding units according to the present invention; and FIG. 3 shows a top view of one of the electrode feeding units.

Figure 1:
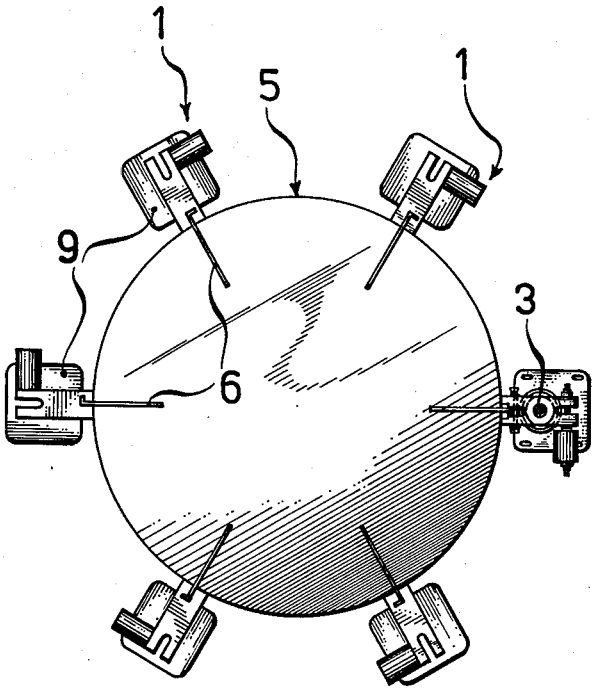
FIG. 1 shows a top view of an electrode with electrode casing and six electrode feeding units, one of the electrode feeding units being shown in detail.

FIG. 1 shows a top view of an electrode casing 5 with continuous, vertical ribs 6 extending radially outwardly from the electrode casing 5. According to the embodiment of the present invention shown on FIG. 1, the electrode casing comprises six ribs 6 extending outwardly from the electrode casing 5. To each rib there is arranged one electrode feeding unit 1. This implies that according to the embodiment of the invention shown on FIG. 1, there is arranged a total of six electrode feeding units 1. The feeding units will be described below in connection with FIGS. 2 and 3.

FIGS. 2 and 3 show a preferred embodiment of the electrode feeding unit 1 according to the present invention. The electrode feeding unit 1 comprises lifting/-lowering means 8 and clamping means 2. The clamping means 2 is formed of two substantially identical, reversed units which are hinged around a vertical member 3.

The clamping means 2 is intended to engage with the ribs 6 extending outwardly from the electrode casing. To press the clamping means 2 against the ribs 6, the electrode feeding unit 1 is furnished with a suitably spring-loaded device 4. The spring-loaded device 4 preferably consists of a helical or a disc spring and a bolt and nut 11. The spring-loaded device 4 is arranged on the clamping means 2 on the same side of the member 3 as the ribs 6. The spring-loaded device 4 is preferably adjustable. According to the embodiment of the present invention shown on FIGS. 2 and 3 the spring-loaded device 4 can be adjusted by tightening or loosening the bolt and nut 11.

The clamping means 2 is on the end remote from the ribs 6 and the spring-loaded device 4 furnished with means for temperorary releasing the pressure exerted by the spring-loaded device 4. According to the embodiment of the present invention shown on FIGS. 2 and 3 the means for temporary releasing the pressure exerted on the ribs is a pneumatic or hydraulic cylinder 7. The piston 10 of the cylinder 7 is at its outer end mounted to one of the two halves of the clamping means 4. When the piston 10 goes into the cylinder 7 the two halves of the clamping means 4 will rotate in opposite direction about the member 3 and hence the pressure exerted on the rib 6 by the clamping means 2 will be released. Since the clamping means 3 is free to rotate about the member 3, the clamping means 4 will be self-adjustable in relation to the rib 6.

According to a prefered embodiment of the present invention the member 3 is a part of the lifting and lowering means 8. The lifting and lowering means 8 is preferably a pneumatic or hydraulic cylinder 8, and the member 3 is the piston of the cylinder 8. The cylinder 8 is mounted on a frame 9 which in turn can be mounted either on the electrode holder casing or on a suspension frame (not shown). Alternatively, the frame 9 can be mounted on a furnace floor (not shown). In the normal position the piston 3 of the lifting and lowering means 8 is in its lower position and the clamping means 2 exerts full pressure to the rib 6. The feeding cyclus is as follows: The cylinder 7 for one of the feeding units is activated and the piston 10 moves into the cylinder. The pressure on the rib exerted by the clamping means 2 is then released and the electrode feeding unit is free to move in vertical direction. The lifting and lowering cylinder 8 is then activated and the clamping means 2 moves upwards as the piston 3 moves out of the cylinder 8. When the piston 3 is in its upper position, the cylinder 7 is deactivated and the pressure exerted on the rib 6 by the clamping means 2 is restored. This cycle is done for every electrode unit 1 around the pheriphery of the electrode, but with a preset time-delay between the cycle for each electrode feeding unit 1. In this way there is only one electrode feeding unit at a time that is not exerting pressure on the ribs 6. When all the electrode feeding units 1 have been lifted to their upper position and they all exert pressure to their ribs, the cylinders 8 for all of the electrode feeding units is deactivated at the same time and the electrode is fed down.

Even if the embodiment of the present invention shown on the figures have six electrode feeding units, it should be obvious that the electrode feeding assembly according to the present invention can have at least two such units and also more than six, for example 8.

What is claimed is:

1. An electrode feeding assembly for supporting and feeding an electrode in an electrothermic smelting furnace said electrode having a casing with a plurality of horizontally spaced generally vertical ribs projecting outwardly therefrom which comprises:

(a) a plurality of horizontally spaced clamping means which support said electrode by exerting clamping pressure on said ribs in one position to impose substantially only tangential forces on said electrode;

(b) each of said clamping means being individually movable in vertical direction upwardly relative to said electrode;

(c) means for temporarily relaxing the clamping pressure of each individual clamping means to move it in vertical direction upwardly relative to said electrode and into a second position and for restoring the clamping pressure when said clamping means are in the second position; and (d) means for individually moving said clamping means in vertical direction upwardly into a second position relative to said electrode while the electrode is supported by a plurality of said individually movable clamping means and for simultaneously moving said electrode and clamping means downwardly to feed the electrode down toward the furnace whereby said clamping means can be moved upwardly one at a time into a second position relative to the electrode and simultaneously moved downwardly to feed the electrode in the furnace.

2. The electrode feeding assembly of claim 11 wherein said clamping means is formed of two separate parts, the two parts being hinged around a central member.

3. The electrode feeding assembly of claim 2 wherein said means for individually moving said clamping means includes said central member which is the movable piston means of a first cylinder.

4. The electrode feeding assembly of claim 3 wherein said first cylinder is mounted on a stationary suspension frame.

5. The electrode feeding assembly of claim 11 wherein the clamping pressure exerted by the clamping means on the rib is imposed by a spring-loaded device.

6. The electrode feeding assembly of claim 5 wherein the pressure exerted by said spring-loaded device can be adjusted by regulation means that includes a bolt and nut.

7. The electrode feeding assembly of claim 11 wherein said means for relaxing and restoring the clamping pressure is the movable piston means of a second cylinder.

8. The electrode assembly of claim 7 wherein said second cylinder is positioned on the other side of the clamping means from the ribs on the electrode casing.

9. The electrode feeding assembly of claim 2 wherein the clamping means is self-adjusting about the central member and relative to the ribs on the electrode casing.

10. A method for feeding and supporting an electrode in an electrothermic smelting furnace said electrode having a casing with a plurality of horizontally spaced generally vertical ribs projecting outwardly therefrom and a plurality of horizontally spaced movable clamping means positioned around the periphery of the electrode, said clamping means being adapted to exert releasable clamping pressure against the ribs to support the electrode and impose substantially only tangential forces on said electrode the method which comprises the steps of:

(a) relaxing the clamping pressure of selected individual clamping means;

(b) individually moving said clamping means upwardly one at a time in vertical direction relative to said electrode while the clamping pressure is relaxed and the electrode is supported by a plurality of said individually movable clamping means;

(c) restoring the clamping pressure of said clamping means on said ribs after said upward movement; and (d) simultaneously moving the clamping means and electrode downwardly to feed the electrode down toward the furnace by said clamping means.

11. The method of claim 12 which includes the step of moving each one of the selected clamping means upwardly the same predetermined distance relative to the electrode.

12. The method of claim 12 which includes the step of moving all of the selected clamping means downwardly simultaneously the same distance that each one of the selected clamping means were individually moved upwardly relative to the electrode.

* * * * *